US011247252B2

(12) United States Patent
Fröhlich et al.

(10) Patent No.: US 11,247,252 B2
(45) Date of Patent: Feb. 15, 2022

(54) METHOD FOR MANUFACTURING A COMPONENT OF AUSTENITIC TWIP OR TRIP/TWIP STEEL

(71) Applicant: Outokumpu Oyj, Helsinki (FI)

(72) Inventors: Thomas Fröhlich, Ratingen (DE); Stefan Lindner, Willich (DE)

(73) Assignee: Outokumpu Oyj, Helsinki (FI)

( * ) Notice: Subject to any disclaimer, the term of this patent is extended or adjusted under 35 U.S.C. 154(b) by 991 days.

(21) Appl. No.: 15/743,366

(22) PCT Filed: Jul. 8, 2016

(86) PCT No.: PCT/EP2016/066318

§ 371 (c)(1),
(2) Date: Jan. 10, 2018

(87) PCT Pub. No.: WO2017/009244

PCT Pub. Date: Jan. 19, 2017

(65) Prior Publication Data

US 2018/0207695 A1 Jul. 26, 2018

(30) Foreign Application Priority Data

Jul. 16, 2015 (EP) ..... 15176945

(51) Int. Cl.

| | |
|---|---|
| ***B21B 1/22*** | (2006.01) |
| ***B21H 8/00*** | (2006.01) |
| ***C21D 1/02*** | (2006.01) |
| ***C21D 7/04*** | (2006.01) |
| ***C22C 38/04*** | (2006.01) |

(Continued)

(52) U.S. Cl.

CPC ..... *B21B 1/227* (2013.01); *B21B 27/005* (2013.01); *B21C 37/02* (2013.01); *B21H 8/005* (2013.01); *C21D 1/02* (2013.01); *C21D 7/04* (2013.01); *C22C 38/04* (2013.01); *B21B 2001/221* (2013.01); *C21D 2211/001* (2013.01)

(58) Field of Classification Search

None

See application file for complete search history.

(56) References Cited

U.S. PATENT DOCUMENTS 5,431,753 A * 7/1995 Kim ..... C21D 8/0205 148/620
7,806,165 B2 10/2010 Kroos et al.
10,144,986 B2 12/2018 Kim et al.

(Continued)

FOREIGN PATENT DOCUMENTS

CN 102312158 A 1/2012
CN 103556052 A 2/2014

(Continued)

*Primary Examiner* — Xiaobei Wang
(74) *Attorney, Agent, or Firm* — The Webb Law Firm

(57) ABSTRACT

The present invention relates to a method for manufacturing a component of austenitic TWIP or TRIP/TWIP steel. A flat product (1) is deformed by achieving at least one indentation (16) on at least one surface of the flat product (1) in order to have in the deformed product (5) areas of a high strength steel embedded in a matrix of a ductile material. The invention also relates to the use of the component where areas of a high strength steel embedded in a matrix of a ductile material are required in the same component.

13 Claims, 2 Drawing Sheets

(51) Int. Cl.
*B21B 27/00* (2006.01)
*B21C 37/02* (2006.01)

(56) References Cited

U.S. PATENT DOCUMENTS

| | | | | |
|---|---|---|---|---|
| 2006/0174983 | A1 | 8/2006 | Gerick et al. | |
| 2006/0179638 | A1 | 8/2006 | Engl et al. | |
| 2010/0051146 | A1 | 3/2010 | Park et al. | |
| 2013/0048150 | A1 | 2/2013 | John et al. | |
| 2013/0338757 | A1 | 12/2013 | Gerold | |
| 2015/0329947 | A1* | 11/2015 | Ferraiuolo | C22C 38/44 148/610 |
| 2015/0336143 | A1 | 11/2015 | Krautschick et al. | |
| 2016/0122839 | A1 | 5/2016 | Evertz et al. | |

FOREIGN PATENT DOCUMENTS

| | | | |
|---|---|---|---|
| DE | 102004054444 | B3 | 1/2006 |
| EP | 2060668 | A1 | 5/2009 |
| EP | 2090668 | A1 | 8/2009 |
| EP | 2649214 | B1 | 12/2016 |
| EP | 1846584 | B1 | 5/2017 |
| JP | H11-319963 | * | 11/1999 |
| KR | 1020100028310 | A | 3/2010 |
| WO | 2005019483 | A1 | 3/2005 |
| WO | 2009090231 | A1 | 7/2009 |
| WO | 2009095264 | A1 | 8/2009 |
| WO | 2011081349 | A3 | 7/2011 |
| WO | 2014096180 | A1 | 6/2014 |
| WO | 2014097184 | A2 | 6/2014 |
| WO | 2014180456 | A1 | 11/2014 |

* cited by examiner

METHOD FOR MANUFACTURING A COMPONENT OF AUSTENITIC TWIP OR TRIP/TWIP STEEL

CROSS-REFERENCE TO RELATED APPLICATIONS

This application is the United States national phase of International Application No. PCT/EP2016/066318 filed Jul. 8, 2016, and claims priority to European Patent Application No. 15176945.2 filed Jul. 16, 2015, the disclosures of which are hereby incorporated in their entirety by reference.

BACKGROUND OF THE INVENTION

Field of the Invention

The present invention relates to a method for manufacturing a component of austenitic TWIP or TRIP/TWIP steel. The indentations are achieved by deforming a flat product of steel in that area of the steel material desired for the utilization of the component.

Description of Related Art

Before manufacturing components for transport systems such as cars, trucks, busses, railway or agricultural vehicles, it shall be calculated how much strength and material thickness is needed for fulfilling the safety requirements. But when there are components which have a higher material thickness than needed, it is described as "overdesigned". Therefore, it is used arrangements to have the right material at the right place. Normally, the calculation is made with a homogeneous material in point of mechanical-technological values (yield and tensile strength, elongation, hardness).

The WO publication 2014/096180 relates to a method for manufacturing profiled metal strips, in which a metal strip with a predefined material thickness consisting, in particular, of stainless steel is wound up on a coil and guided through a rolling stand containing several rolls. At least a part of the rolls that effectively interact with the metal strip are provided with a predefined topography, by means of which profiles with profile depths more than 250 micrometer can be produced on both sides of the metal strip depending on the geometry of the topography of the rolls. The metal strip is subsequent to its profile wound up on a coil and, if so required, subjected to a thermal post-treatment. The object of the WO publication 2014/096180 is thus just to achieve a predefined topography on both sides of a metal strip having the predefined strip thickness. Further, the WO publication 2014/096180 does not teach anything how to bypass the traditional conflict to create high strength together with high elongation

SUMMARY OF THE INVENTION

The object of the present invention is to eliminate some drawbacks of the prior art and to achieve a method for manufacturing a component of an austenitic steel which not only have effect to the thickness of the steel material, but also have effect to other mechanical properties, such as strength and ductility. The essential features of the present invention are enlisted in the appended claims.

According to the present invention for manufacturing a component a flat product of austenitic steel with the TWIP (Twinning Induced Plasticity) hardening effect or a flat product of austenitic steel with a combination of the TRIP (Transformation Induced Plasticity) and the TWIP (Twinning Induced Plasticity) effects is deformed to have a product with at least one indentation. The deformed product combines areas of a high strength steel embedded in a matrix of a ductile material. The area with high strength has both high strength and high hardness, while the area of a ductile material has high elongation. The invention also relates to the use of the component where areas of a high strength steel embedded in a matrix of a ductile material are required in the same component.

During manufacturing of the deformed product, at least one indentation is created on at least one surface of the deformed product by means of a mechanical contact between the flat product and the deformation equipment, such as a cold rolling mill. The indentation has a geometry which depends on the requirement for the utilization of the deformed product. The deformed product with at least one indentation has better elongation in combination with strength, better fatigue behavior and lower crack growth, lower springback during the deformation as well as higher safety during the lifetime of the deformed product, when compared with the prior art.

The flat product is made of a steel having an austenitic microstructure. The steel utilizes the TWIP (Twinning Induced Plasticity) hardening effect or a combination of the TRIP (Transformation Induced Plasticity) and the TWIP (Twinning Induced Plasticity) effects with the stacking fault energy at the range of 20-30 mJ/m$^2$. The austenitic steel contains 10-25 weight % manganese, preferably 14-18 weight % manganese, and has interstitial disengaged nitrogen (N) and carbon (C) atoms with the (C+N) content being at the range of 0.4-0.8 weight %. In the case when the steel has a metastable austenitic microstructure with the TRIP hardening effect, the resulting stacking fault energy is lower than 20 mJ/m$^2$. In this case the steel also contains 10-20.5 weight % chromium, preferably 13-17 weight % chromium, and 3.5-9.5 weight % nickel.

The flat product according to the present invention is advantageously a flat sheet, a strip as well as a slit strip, a panel or a plate. The initial thickness of the flat product before deforming is 0.15-4.0 millimeter, preferably 0.8-2.0 millimeter. The flat product is advantageously deformed by cold rolling so that at least one roll is a profiled roll in order to create at least one indentation with a desired geometry on the surface of the flat product in the direction transverse to the rolling direction. In preferred embodiments of the present invention at least one roll is so profiled, that two or more indentations with a desired geometry are created on the surface of the flat product in the direction transverse to the rolling direction or in the direction parallel to the rolling direction or both in the direction transverse to the rolling direction and in the direction parallel to the rolling direction. The profiles in at least one roll for the creation of indentations can be essentially similar to each other in one embodiment of the invention, but the profiles in at least one roll for the creation of indentations can also be essentially different from each other in another embodiment of the invention. According to the present invention only one working roll of the cold rolling mill has the desired profile, and thus only one surface of the flat product is deformed. However, it is also possible that both the working rolls in the cold rolling mill are profiled and thus two surfaces of the flat product are deformed. After deforming, the deformed product can be coiled to be further processing as a coiled product, but the deformed product can also be utilized in further processing as a deformed flat product.

The indentation in the deformed product according to the invention has geometry of a honeycomb, a wave, a triangle, a rectangle, a circle, a cross, a line, a ripple, a cobweb or any combination of these geometries. The geometry of the indentation is dependent on the utilization of the deformed product, because areas in the deformed product with different values for mechanical properties are created by the indentation. Based on different values for mechanical properties the deformed product has for instance good fatigue behavior as a homogenous material with only the ductile area properties.

In the utilization of the TWIP (Twinning Induced Plasticity) hardening effect or a combination of the TRIP (Transformation Induced Plasticity) and the TWIP (Twinning Induced Plasticity) effects in the deformed product according to the present invention the level of hardening depends on the deforming level and, therefore, the level of hardening correlates to the depth of the indentation. The profile depth for the indentations can be different in one deforming roll and, therefore, also the geometry of the indentations can be different. The indentations from one side of the flat product can be deformed with a depth of up to 30% calculating from the initial thickness of the flat product. In a case when it is required to reverse the hardening effect created with the deforming of the flat product, the hardening effect is reversible with annealing at the temperature at the range 900-1250° C., preferably 900-1050° C.

The deformed product with at least one indentation in accordance with the present patent invention can be utilized as a component at least in the following target areas:

- A high strength sheet or coil manufactured with a springback relevant forming process for the automotive car body construction,
- A safety relevant component in an automotive car body construction like members, pillars, cowl, roll bar, bumper, crashbox, channel or a seat-component like a cross tube,
- A fatigue designed component in an automotive car or railway vehicle body like chassis-parts, control arm, buffer or a strut dome,
- A stiffness relevant component in a railway vehicle like a side wall or a floor,
- A tube or profile for constructions in buses, trucks, railway vehicles or steel building constructions.

BRIEF DESCRIPTION OF THE DRAWINGS

The deformed product manufactured in accordance with the present invention is described in more detail referring to the following drawings, where.

DESCRIPTION OF THE INVENTION

The material of the FIGS. 1-4 is an austenitic stainless steel having the TWIP effect and containing as the main components with iron in weight % 0.3 carbon, 16% manganese, 14% chromium, less than 0.5% nickel and 0.3% nitrogen.

Figure 1:
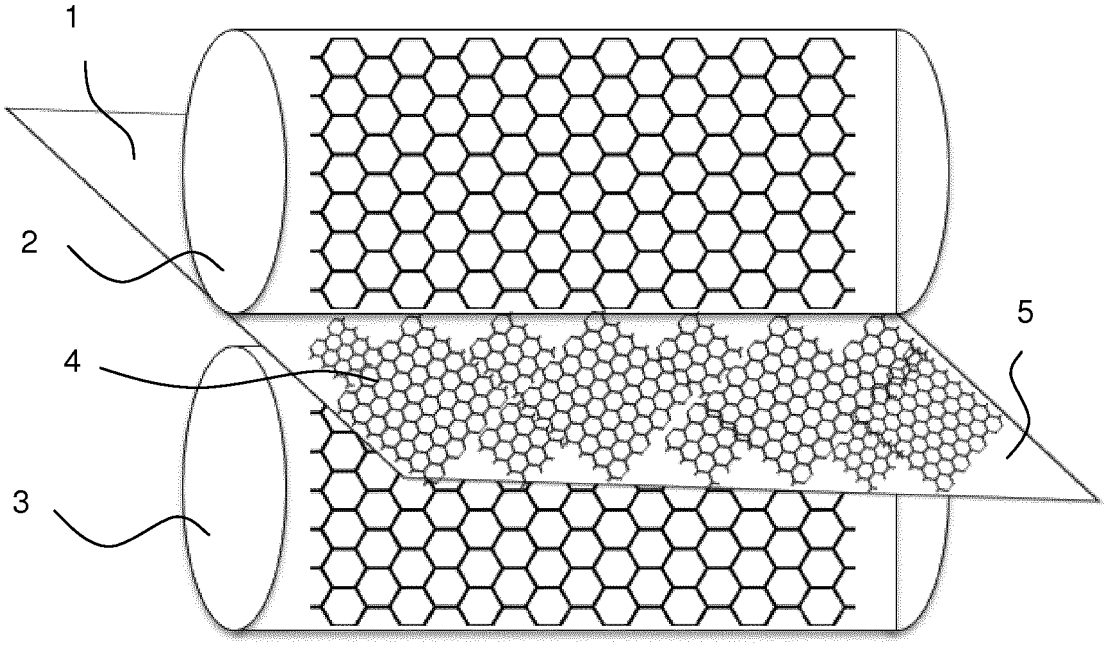
FIG. 1 illustrates one preferred embodiment of the invention schematically as a distortion view seen from the side after deformation.

According to FIG. 1 a flat strip 1 is running through a cold rolling mill, which is illustrated by the working rolls 2 and 3. The rolls 2 and 3 are profiled to create indentations both in the direction transverse to the rolling direction and in the direction parallel to the rolling direction which indentations form a honeycomb structure 4 on the surfaces of the deformed strip 5.

Figure 2:
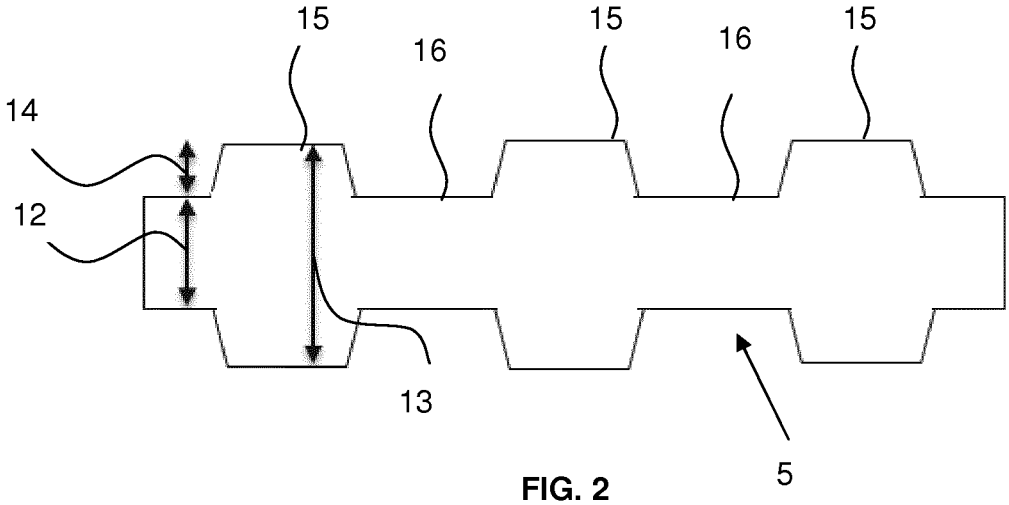
FIG. 2 illustrates a partial and enlarged point for the embodiment of the FIG. 1.

In FIG. 2 it is shown one part of the deformed strip 5 of FIG. 1. The initial thickness of the flat strip is shown as the reference number 13 and the depth of an indentation, with the value of 30%, as the reference number 14. The deformed strip 5 with the deformed thickness 12 has on the surfaces non-deformed areas 15 with high ductility and high elongation. The indentations 16 created by the working rolls 2 and 3 (FIG. 1) of the cold rolling mill form high deformed areas with high strength and high hardness on the surfaces of the deformed strip with the thickness 12.

Figure 3:
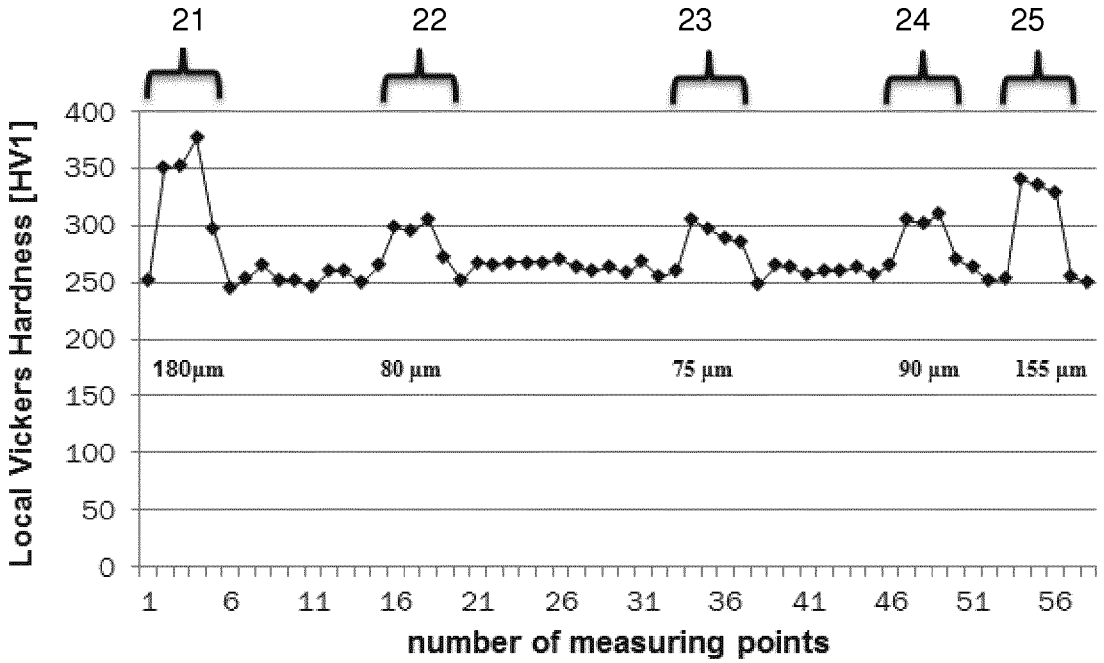
FIG. 3 illustrates the effect of depth of indentations.

FIG. 3 shows test results in a coordination where the horizontal axis represents measuring points in a test sample which was deformed in accordance with the present invention. The test sample was deformed in five areas 21, 22, 23, 24 and 25 having different indentation depths of 180, 80, 75, 90 and 155 micrometer respectively. The vertical axis of the coordination represents local Vickers hardness (HV1). The test results of FIG. 3 show that the Vickers hardness (HV1) is directly proportional to the indentation depth in the test sample.

Figure 4:
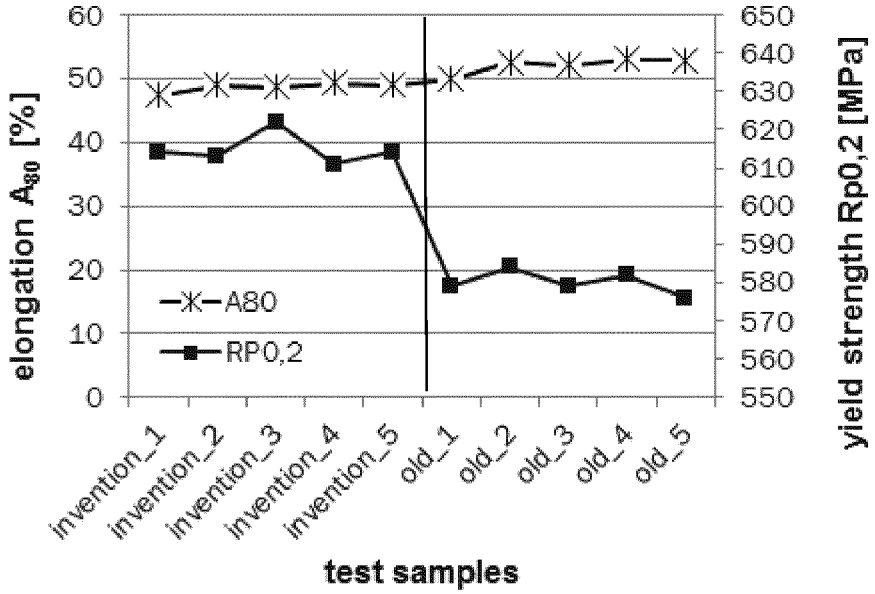
FIG. 4 illustrates the comparison of properties between the deformed product of the invention and the deformed standard material.

FIG. 4 shows test results when the elongation ($A_{80}$) and the yield strength $R_{p0.2}$ were measured from the test samples where the test samples (invention_1 . . . 5 were deformed in order to create indentations on the surface of the material in accordance with the present invention. The other test samples (old_1 . . . 5 were not deformed because of the comparison. FIG. 4 shows that the non-deformed test samples have greater elongation values than the deformed test samples, but the non-deformed test samples have an essential decrease in the yield strength when compared with the deformed test sample. The deformation for creating indentations on the surface of the material achieves to have both high strength and high elongation simultaneously.

The invention claimed is:

1. A high strength sheet comprising austenitic twinning induced plasticity (TWIP) or transformation induced plasticity/twinning induced plasticity (TRIP/TWIP) steel with deformed indentations having areas of high strength in a matrix of ductile material, wherein a hardness of the sheet in an area of the indentations is reversible by annealing the sheet at a temperature of 900-1250° C.

2. The high strength sheet of claim 1, wherein the annealing temperature is 900-1050° C.

3. The high strength sheet of claim 1, wherein the sheet comprises 10-25 weight % manganese and has interstitial disengaged nitrogen and carbon atoms, wherein a total carbon and nitrogen content is 0.4-0.8 weight %.

4. The high strength sheet of claim 3, wherein the sheet further comprises 10-20.5 weight % chromium and 3.5-9.5 weight % nickel.

5. The high strength sheet of claim 1, wherein the sheet has a stacking fault energy of 20-30 mJ/m$^2$.

6. The high strength sheet according to claim 1, wherein a thickness of the sheet in an area outside of the indentations is 0.15-4.0 millimeter.

7. The high strength sheet according to claim 6, wherein a depth of the indentations is up to 30% of a thickness of the sheet in an area outside of the indentations.

8. The high strength sheet according to claim 7, wherein the TWIP or TRIP/TWIP effect is directly proportional to the indentation depth.

9. The high strength sheet according to claim 6, wherein the indentations have a shape of a honeycomb, a wave, a triangle, a rectangle, a circle, a cross, a line, a ripple, a cobweb, or any combination of these geometries.

10. A method for manufacturing the high strength sheet of claim 1, wherein an austenitic twinning induced plasticity (TWIP) or transformation induced plasticity/twinning induced plasticity (TRIP/TWIP) steel sheet is deformed by achieving at least one indentation on at least one surface of the steel sheet in order to have, in the deformed product, areas of a high strength embedded in a matrix of a ductile material.

11. The method according to claim 10, wherein deformation of the steel sheet is achieved by cold rolling using at least one roll that is a profiled roll in order to create at least one indentation in a direction transverse to the rolling direction with a desired geometry on the surface of the steel sheet.

12. The method according to claim 10, wherein deformation of the steel sheet is achieved by cold rolling using at least one roll that is a profiled roll in order to create two or more indentations in a direction parallel to the rolling direction with a desired geometry on the surface of the steel sheet.

13. The method according to claim 10, wherein deformation of the steel sheet is achieved by cold rolling using at least one roll that is a profiled roll in order to create two or more indentations both in a direction transverse to the rolling direction and in a direction parallel to the rolling direction with a desired geometry on the surface of the steel sheet.

* * * * *